United States Patent [19]

Arnold

[11] Patent Number: 4,575,224

[45] Date of Patent: Mar. 11, 1986

[54] ELECTROGRAPHIC APPARATUS HAVING AN ON-LINE DENSITOMETER

[75] Inventor: Kenneth A. Arnold, Rochester, N.Y.

[73] Assignee: Eastman Kodak Company, Rochester, N.Y.

[21] Appl. No.: 678,728

[22] Filed: Dec. 5, 1984

[51] Int. Cl.[4] ..... G03G 15/00

[52] U.S. Cl. ..... 355/14 R; 355/3 CH; 355/14 CH; 355/14 E

[58] Field of Search ..... 355/14 R, 3 R, 14 CH, 355/14 E, 3 CH, 3 DP, 14 D, 3 TR; 118/691, 712

[56] References Cited

U.S. PATENT DOCUMENTS

| | | | |
|---|---|---|---|
| 3,348,522 | 10/1967 | Donohue | 118/7 |
| 3,674,353 | 7/1972 | Trachtenberg | 355/3 DD |
| 3,779,203 | 12/1973 | Altmann | 118/8 |
| 3,779,204 | 12/1973 | Altmann | 118/8 |
| 3,872,825 | 3/1975 | Davidson | 118/7 |
| 4,183,657 | 1/1980 | Ernst et al. | 355/14 R |
| 4,239,372 | 12/1980 | Iwai | 355/14 R |
| 4,272,182 | 6/1981 | Abe et al. | 355/14 D |
| 4,277,162 | 7/1981 | Kasahara et al. | 355/14 R |
| 4,284,344 | 8/1981 | Okamoto et al. | 355/14 CH X |
| 4,313,671 | 2/1982 | Kuru | 355/14 D |
| 4,326,796 | 4/1982 | Champion et al. | 355/3 CH X |
| 4,348,100 | 9/1982 | Snelling | 355/14 R |
| 4,365,894 | 12/1982 | Nakamura | 355/77 |
| 4,372,672 | 2/1983 | Pries | 355/14 R |
| 4,536,082 | 8/1985 | Motohashi et al. | 355/14 E X |

OTHER PUBLICATIONS

IBM Technical Disclosure Bulletin, vol. 24, No. 9, Feb. 1982.

*Primary Examiner*—A. C. Prescott

*Attorney, Agent, or Firm*—G. Herman Childress

[57] ABSTRACT

An electrographic apparatus has a transparent photoconductor on which visible images are formed by applying toner to a latent electrostatic image. The toned image is subsequently transferred to a copy sheet and fused to the sheet. A post-development erase lamp is located on one side of the photoconductor. The density of toned images on the photoconductor is measured by light rays from the erase lamp traveling through the photoconductor and a toned control image thereon to a photodetector on the opposite side of the photoconductor. This eliminates the need for special lamps used only for measuring the density of toned control images.

4 Claims, 2 Drawing Figures

ELECTROGRAPHIC APPARATUS HAVING AN ON-LINE DENSITOMETER

BACKGROUND OF THE INVENTION

This invention relates to an electrographic apparatus having a transparent photoconductor and a densitometer for measuring the density of toned images on the photoconductor.

Apparatus disclosed in U.S. Pat. No. 4,277,162, issued July 7, 1981, measures the density of toned images produced by electrographic apparatus and transferred to a belt. The apparatus includes a sensor and one or more special light sources which either reflect light rays off of the toned image to the sensor or project light rays through the toned image and the belt to the sensor. The output of the sensor corresponds to the amount of light transmitted through or reflected off of the toned image. The output of the sensor is coupled to a control circuit used to control process parameters in the electrographic apparatus.

Prior electrographic apparatus having densitometers present certain problems. Some apparatus use a small light source, such as a light emitting diode (LED) which is provided solely for the purpose of measuring density or some other parameter. Some apparatus rely on a light scattering principle, thus requiring a relatively large area photodiode or other photodetector to receive light rays from the light source. Apparatus using the scattering principle are sensitive to the position of the photoconductor relative to the light source and photodetector. As a result, the position of the photoconductor must be accurately controlled relative to the light source and detector. The position of the photoconductor frequently is carefully controlled in apparatus where the photoconductor comprises a coated drum or an endless belt. However, the position of a photoconductor in the form of a sheet is more difficult to control.

SUMMARY OF THE INVENTION

It is an object of the invention to provide an electrographic apparatus having a densitometer which eliminates the need for a separate light source, such as an LED, and a large area photodetector. Another object of the invention is to provide a densitometer for electrographic apparatus which has lower sensitivity to the position of the photoconductor and to variations in the position of the photoconductor.

In accordance with the present invention, electrographic apparatus is provided having a movable transparent photoconductor and means for producing a toned image on a first surface of the photoconductor. A transfer station is provided at which the toned image can be transferred to a copy sheet. A post-development erase station has a lamp located adjacent a second surface of the photoconductor as the photoconductor moves between the image-producing means and the transfer station. Density of toned image on the photoconductor is measured by a photodetector located adjacent the first surface of the photoconductor and positioned to receive light rays from the erase lamp so that the photodetector senses light passing through the toned images on the first surface of the photoconductor.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

To assist in understanding the present invention, an electrophotographic copier/duplicator in which the invention may be used will be briefly described. It will be understood, however, that the apparatus of the present invention can be used in other types of apparatus.

Figure 1:
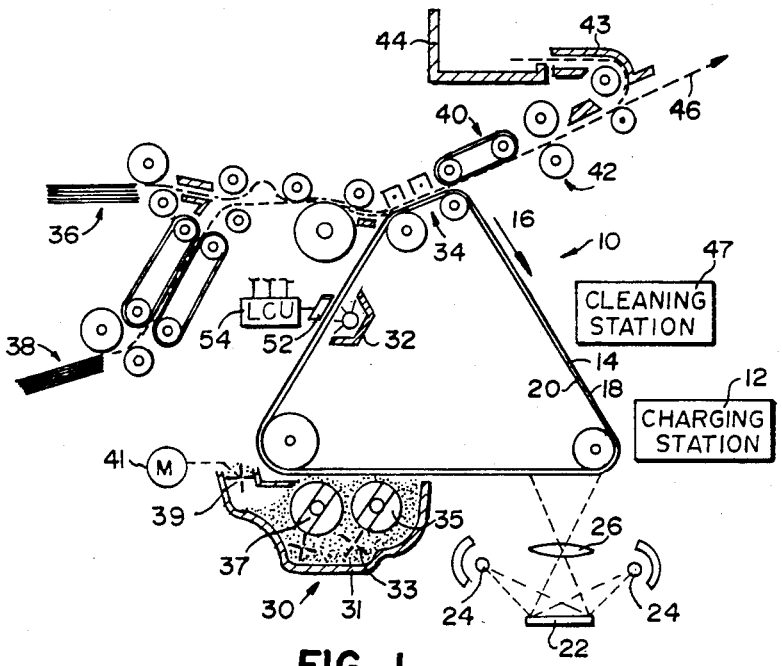
FIG. 1 is a schematic vertical section of an electrophotographic apparatus including an on-line densitometer of the present invention.

Referring now to the drawings in detail, an electrophotographic apparatus generally designated 10 in FIG. 1 includes a charging station 12 which is effective to apply a uniform charge on a transparent photoconductor 14. The photoconductor illustrated is an endless web trained about a plurality of rollers and driven in the direction indicated by the arrow 16. Photoconductor 14 has a first surface 18 on the exterior of the web and a second surface 20 on the inside or backside of the web. The web may comprise a layer of photoconductive material at or adjacent to surface 18 and a conductive backing or support layer.

Figure 2:
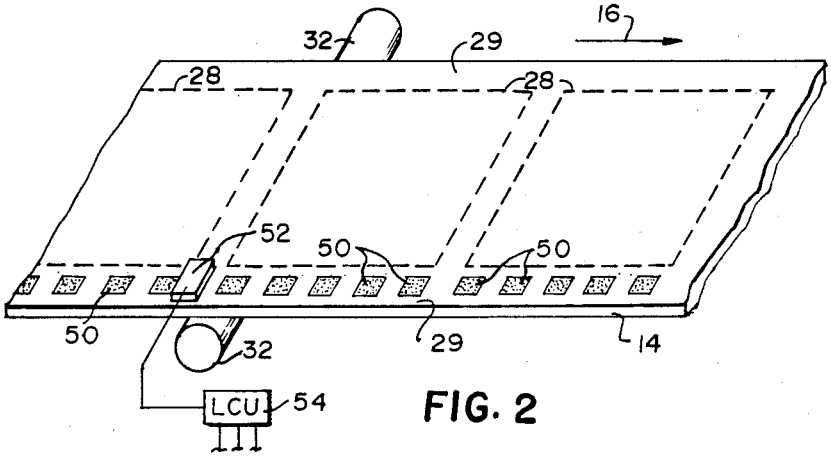
FIG. 2 is an enlarged fragmentary perspective view of the portion of the apparatus containing the densitometer.

An information medium 22, such as a document to be copied, is illuminated by radiation from flash lamps 24, and the radiation is reflected from the document and projected by a lens 26 onto the surface 18 of the photoconductor. The radiation striking the charged photoconductor selectively dissipates portions of the charge to form an electrostatic latent image on the photoconductor. As shown in FIG. 2, the photoconductor has a plurality of image areas or film frames 28 that are spaced slightly from each other along the length of the web and are also spaced from the side edges of the web. The charge in the area outside the image areas is selectively erased by discharge lamps (not shown) in a conventional manner. Thus an elongate non-image area 29 is provided along each side edge portion of the web.

A magnetic brush development station 30 comprises a housing 31 having a reservoir for a supply of developer material 33 comprising, for example, toner particles and carrier particles. One or more magnetic development brushes are provided for transferring toner particles to the photoconductor for developing the latent image, two such brushes 35 and 37 being illustrated in the drawings. Station 30 also includes a toner replenisher 39 which is adapted to furnish new toner to the reservoir beneath the brushes when a motor 41 is driven. As the latent image of document 22 on the photoconductor 14 passes through the development station, the latent image is developed by toner particles from the development station.

The resulting toned image then travels past a post-development erase station comprising an erase lamp 32 located adjacent surface 20 of the photoconductor. Lamp 32 effective to erase any undeveloped latent image that may remain on the photoconductor after it passes the development station. The erase lamp may also reduce electrical stress in the photoconductor.

The toned image next reaches a transfer station 34 where it is transferred to a copy sheet of paper. The copy sheets are fed from a selected one or two paper supplies 36 or 38. The copy sheet with the toned image thereon is delivered by a vacuum transport 40 to a fusing station 42 where the toner on the sheet is fused to the sheet by heat and pressure. The copy sheet is delivered either along a path 43 leading to a tray 44 or along a path 46 leading to another tray, a finishing apparatus, etc. After the photoconductor passes through transfer station 34 it is cleaned in a cleaning station 47 and is available for another cycle of operation.

Electrophotographic apparatus as generally described hereinbefore is disclosed in more detail in U.S. Pat. No. 4,141,645. Reference is made to such patent for a more complete description of the apparatus and its operation.

In order to control the electrophotographic process, it is known to provide one or more sample control areas 50 of toner in the non-image area 29 of the photoconductor. The control area can be formed by leaving such areas charged when the other parts of the photoconductor outside image areas 28 are discharged, and then exposing the areas to a predetermined level of irradiation. Then toner is applied to the control areas by development station 30. In this manner the density of toner in control areas 50 is directly related to the density of toner in image areas 28. By way of example, five toned control areas 50 are shown adjacent each one of the image areas 28 on photoconductor 14; however, more or fewer control areas could be provided if desired. When multiple control areas for each image area are used for density measurement, the areas preferably are exposed to obtain different density levels of toner so that the electrophotographic process can be checked and controlled for various operating parameters. Each of the control areas 50 can be approximately one inch square, for example, and are spaced from each other along the length of the photoconductor.

As the control areas 50 pass under the erase lamp 32, light rays from the lamp travel from the back side 20 of the photoconductor through the photoconductor and the control areas 50 on the front surface 18 of the photoconductor. A photodetector in the form of a small area photodiode 52 is provided closely adjacent the surface 18 of the photoconductor for receiving light rays passing through the control areas 50 as they are driven between the lamp 32 and the photodetector. The light-receiving portion of the photodetector preferably is relatively small or shielded so that at any one time it receives light rays passing through only one of the control areas 50. Preferably the photodetector receives rays directly from an area 50 instead of scattered light rays. A signal generated by the photodetector 52 is provided to a logic and control unit 54 of electrographic apparatus 10. The logic and control unit is programmed to provide various feedback signals to portions of the apparatus in response to the signal received from the photodetector. For example, the control signal from the photodector can cause the logic and control unit to regulate a number of process parameters such as the voltage applied to the photoconductor 14 at the charging station 12, the intensity level of lamps 24 at the exposure station to thereby control the exposure of the photoconductor and, when screens are used, to control the spacing of the screen relative to the photoconductor. In general, the signal from the photocodetector 52 can be used to control any process parameter that effects the density of the toned images on the photoconductor.

A number of advantages are achieved by the present invention. First of all, the separate light source normally provided for on-line densitometers has been eliminated and light rays from the erase lamp utilized for the purpose of measuring density. Secondly, the relatively large area light source comprising erase lamp 32 permits the use of a small area photodiode. As pointed out previously, the scattering of light rays in prior devices required the detector to be a relatively large area photodiode. Also, the apparatus of this invention is less sensitive to the position of the photoconductor relative to the photodiode because it does not rely on the scattering principle used by prior apparatus.

The invention has been described in detail with particular reference to a preferred embodiment thereof, but it will be understood that variations and modifications can be effected within the spirit and scope of the invention.

I claim:

1. In electrographic apparatus having a movable transparent photoconductor, means for producing toned images on a first surface of the photoconductor, a transfer station at which a toned image can be transferred to a copy sheet, and a post-development erase station comprising a lamp located adjacent a second surface of the photoconductor between the image-producing means and the transfer station, the improvement comprising:

a photodetector located adjacent the first surface of the photoconductor and positioned to receive light rays from the erase lamp so that the photodetector senses light passing through toned images on the first surface of the photoconductor.

2. The invention as set forth in claim 1 wherein the photodetector comprises a small area photodiode positioned relative to the photoconductor for receiving light rays passing through a side edge portion of the photoconductor, and wherein the means for producing toned images comprises means for providing a series of toned control areas of varying density along the portion of the photoconductor that passes between the erase lamp and the photodiode.

3. In electrographic apparatus having a series of stations and a transparent photoconductor movable past the stations, the stations including a charging station at which the photoconductor receives a uniform electrostatic charge on a first surface of the photoconductor, an exposing station at which some of the charge on the photoconductor can be removed to form a latent electrostatic image on the photoconductor, a developing station for applying toner to the electrostatic image on the photoconductor to form a toned image, a transfer station at which the toned image can be transferred to a copy sheet, and a post-development erase station at which any undeveloped latent image is removed from the photoconductor, the erase station comprising a lamp for irradiating the photoconductor, the lamp being adjacent a second surface of the photoconductor between the developing station and the transfer station, the improvement comprising:

a photodetector located adjacent the first side of the photoconductor and positioned with respect to the erase lamp to receive light rays from the erase lamp after such rays have passed through the photoconductor so that the photodetector can measure the quantity of light passing through toned images on the first surface of the photoconductor.

4. The invention as set forth in claim 3 wherein the photoconductor has (1) a series of image areas along a central portion thereof on which images are formed for transfer to a copy sheet and (2) an elongate non-image area along a side edge portion of the photoconductor, the apparatus being adapted to form a series of toned control areas of various densities in the non-image area of the photoconductor, and wherein the photodetector comprises a small area photodiode positioned to receive light rays from the lamp that pass through one toned central area in the non-image area of the photoconductor.

* * * * *